US005915320A

United States Patent [19]

Wang

[11] Patent Number: 5,915,320

[45] Date of Patent: Jun. 29, 1999

[54] METHOD OF FORMING A GOLF BAG INSERT

[76] Inventor: Jessie Li-Kuo Wang, 46980 Octotillo Ct., Fremont, Calif. 94539

[21] Appl. No.: 09/033,974

[22] Filed: Mar. 3, 1998

[51] Int. Cl.[6] ..... D05B 97/00; A63B 55/00

[52] U.S. Cl. ..... 112/475.08; 206/315.6

[58] Field of Search ..... 112/475.08, 440, 112/441; 206/315.6, 315.3, 315.8, 315.5

[56] References Cited

U.S. PATENT DOCUMENTS 5,662,058 9/1997 Wang ..... 112/475.08

5,816,398 10/1998 Wang ..... 206/315.6

5,845,773 12/1998 Kim ..... 206/315.6

*Primary Examiner*—Peter Nerbun

*Attorney, Agent, or Firm*—Linval B. Castle

[57] ABSTRACT

A method for constructing a soft fabric insert for golf bags with partitions for golf clubs. The method includes stitching a center section having an "X" cross section and four wider sheets formed with a cross section resembling the letter "M" with By stitching the four edges of the center "X" between selected double legs of the "M" sheets, stitching together the outer legs of the "M" sheets, and sewing the edges of the "M" sheet to a cover which is closed to become tubular, an insert may be formed with partitions numbering from twelve to sixteen.

1 Claim, 5 Drawing Sheets

METHOD OF FORMING A GOLF BAG INSERT

This application describes a method for fabricating partitioned inserts for golf bags and is an improvement over the method described in my U.S. Pat. No. 5,662,058, issued September 1997.

BRIEF SUMMARY OF THE INVENTION

This invention relates to golf club bags and in particular to inserts for golf bags that contain a partition for keeping the grips of the several clubs separated and free from damage.

The quantity of partitions in an insert is generally fourteen since that is the maximum number of clubs a tournament golfer may carry, but the week-end golfer may desire more of fewer partitions. To give full protection to the club shafts and grips, the partitions must extend the full depth of the golf bag and must be formed of a soft material that cannot scratch or bruise the club. A strong fabric makes an ideal partition; it is light in weight and is easily formed into the desired partitions.

The partitioned insert described in my U.S. Pat. No. 5,662,058 used eleven sheets of dacron fabric, stitched together in a complex pattern to form a full length golf bag insert with fourteen partitions. The partitioned insert of the present invention is formed of seven sheets of fabric having a length equal to the depth of the golf bag into which it will fit. One sheet forms the tubular exterior of the insert and has a width equal to the inside circumference of the golf bag. If it is assumed that the individual partitions are approximately two inches square, two sheets of fabric, each with a width of about five inches are stitched together along their centerlines to form a piece with a cross section resembling the letter "X"; and four sheets about twelve inches wide are marked along the centerlines and will be formed into pieces resembling the letter "M". With this number of pieces of fabric, partitioned golf bag inserts may be fabricated with any number from twelve to sixteen partitions

BRIEF DESCRIPTION OF THE DRAWINGS

In the drawings that illustrate the preferred embodiment of the invention.

DETAILED DESCRIPTION

The golf bag insert is a soft fabric tube, open on the top and closed on the bottom end, that is partitioned with a number of individual partitions for inserting into a conventional golf bag for holding and separating golf clubs and particularly their handles or grips.

Figure 1:
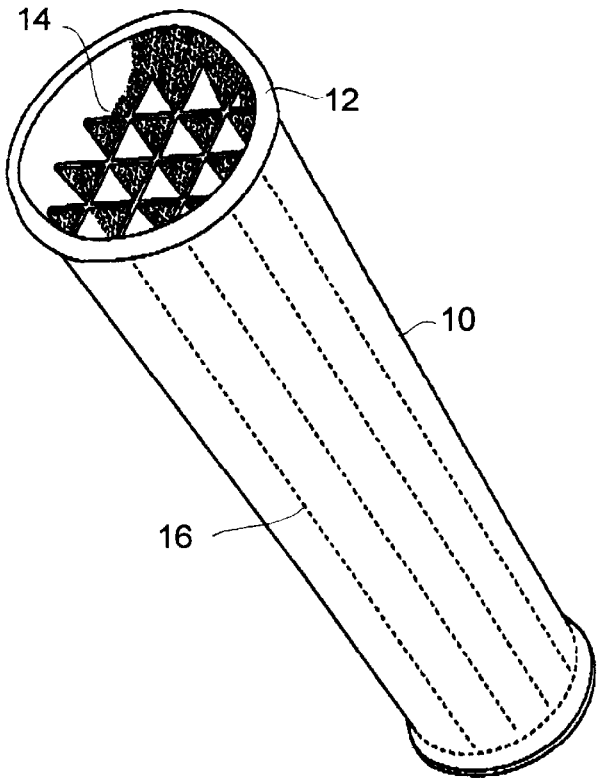
FIG. 1 is a perspective view of a golf bag insert.

FIG. 1 is a perspective view of a golf bag insert illustrating the long soft fabric tube 10 shown with a top ring 12 for attaching the insert to a golf bag and with a pattern of sixteen square partitions 14 for the golf clubs. The longitudinal edges of the partitions are shown stitched to the fabric tube 10 by the dotted lines 16 and the bottom end of the insert is closed with the closure stitched to the various partitions to secure the partition fabrics when a club is being removed.

Figure 2:
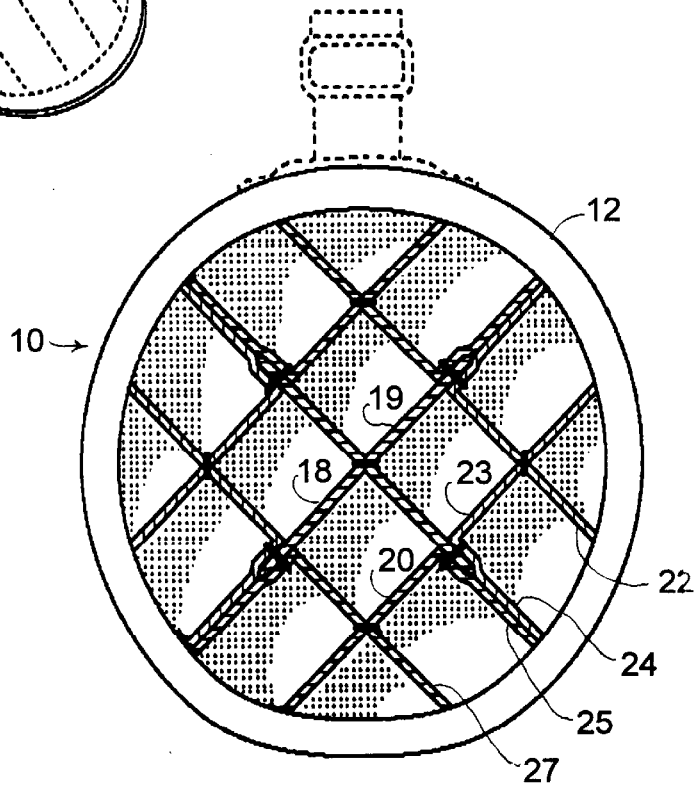
FIG. 2 is a plan view of a sixteen partition insert in a golf bag.

FIG. 2 is a detailed plan view of the insert 10 of FIG. 1 in a golf bag with circular cross section. In FIG. 2 the various fabric strips are illustrated and show that the center formed of two strips 18, 19 that are stitched together to resemble an "X". The edges of both of these strips are stitched between the center sections of four strips each resembling the letter "M"; for example, one edge of "X" strip 19 is stitched between legs 24 and 25 of the "M" strip formed of legs 20, 22, 23, 24, 25, 27. This is the fundamental concept of all embodiments of this invention. From these four "M" strips grasping the edges of the central "X" strip, golf bag inserts may be formed with partitions numbering from twelve to sixteen merely by arranging and stitching the outer legs. e.g. the legs 22, 27, to adjacent "M" strip outer legs or to the surrounding fabric of the tubular insert.

Figure 3:
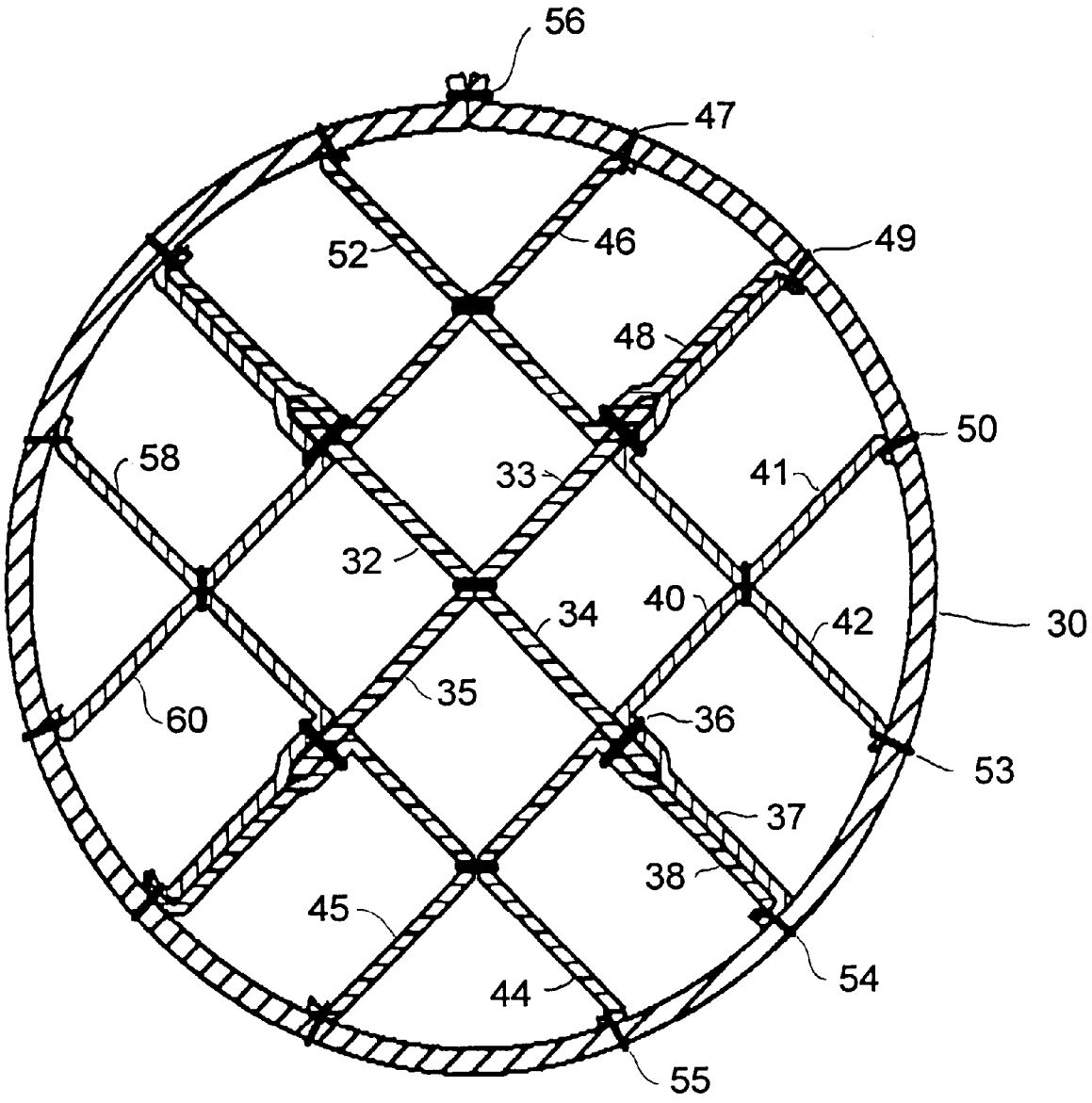
FIG. 3 is a detailed plan view of the sixteen partition insert.

FIG. 3 is a enlarged view of the basic embodiment and the sixteen partition insert. If it is assumed that the inside diameter of the golf bag requires a fabric insert with an eight inch diameter, then the width of the fabric required for the tubular outer cover 30 is the inside circumference or about twenty-six inches, including about ⅜" at each edge for stitching the tube together. The length of the fabric is the inside length of the golf bag.

While this twenty-six inch piece of outer cover 30 is still flat is should be chalk marked on one surface with longitudinal lines that represent the locations of all of the edges of the legs of the "M" strips that are to be stitched to the fabric cover. These chalk marks will correspond to the dotted lines 16 on the fabric tube 10 of FIG. 1.

The first step in the formation of the partitions is to make the central "X" portion from two strips of fabric each having a width equal to about twice the width of a single partition, or about 4½ inches wide for the eight inch diameter insert illustrated in FIG. 2. The two strips are stitched together along their longitudinal centerlines and forms a pattern with a "X" cross section with four legs 32, 33, 34, 35.

Next, four sheets of fabric, each approximately six times the width of a single partition, or twelve inches wide by the length of the insert, will be stitched to grasp the edges of the four legs of the "X" fabric. For example, in FIG. 3 the twelve inch wide fabric sheet that will grasp the leg 34 is longitudinally folded in its center and about two inches from that center fold it is stitched to the edge of leg 34 at point 36, the two legs 37 and 38 eventually forming the central legs of an "M" strip. That leaves approximately four inches of fabric extending from the point 36 to each end of the twelve inch sheet.

All four "M" strips are identically formed to grasp the four legs of the central "X" strip.

After the four edges of the "X" strips have been stitched into the center legs of the "M" strips as described above, the outer legs of all adjacent "M" strips are longitudinally stitched together approximately two inches from their points of connection; for example, the fabric leg 42 is stitched to the leg 41 of the adjacent "M" strip approximately two inches along section 40 from the point 36 connecting the central legs 37, 38 to the edge 34 of the "X" strip. This connection forms rectangular partitions two inches square between the "X" strip and the "M" strips, but still leaves the outer legs 42, 44 of the "M" strip free and unattached.

After all the legs of adjacent "M" strips have been stitched together as described above, the central double legs and the free and unattached outer legs of the "M" strips may be stitched to the flat outer cover 30 which has been previously chalk-marked with longitudinal lines indicating the desired locations of attachment of the legs. Starting near one edge of the cover 30, sew the outer leg 46 of an "M" strip to the cover 30 at point 47, the fold in the central double leg 48 at point 49, and the edge of the opposite outer leg 41 at point 50. Proceeding to the next "M" strip, sew the edge of the outer leg 42 to the cover 30 at point 53, the fold in the double central leg 37, 38 at point 54 and the edge of the opposite outer leg 44 at point 55. Continue in this manner until all of the central and outer legs of the "M" strips are attached to the fabric of the cover 30, and finally form the cover into its tubular shape by stitching the edges together at point 56. It should be pointed out that, while the foregoing description states that the insert has a tubular shape, the tubular insert may be made to readily conform to irregular shaped golf bags, such as those having oval or square cross section, using the method described herein.

Figure 4:
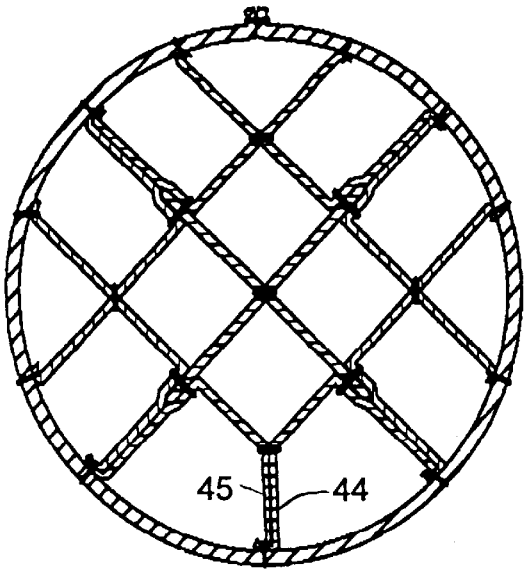
FIG. 4 is a plan view of a fifteen partition insert.

The above process forms a golf bag insert with sixteen club partitions. If fewer partitions are desired, ti is only necessary to combine some of the legs of the "X" strip or adjacent edges of the "M" strips. For example, if fifteen partitions are desired in the insert, outer edges 44 and 45 may be doubled into a single divider. The fifteen partition embodiment is illustrated in FIG. 4.

Figure 5:
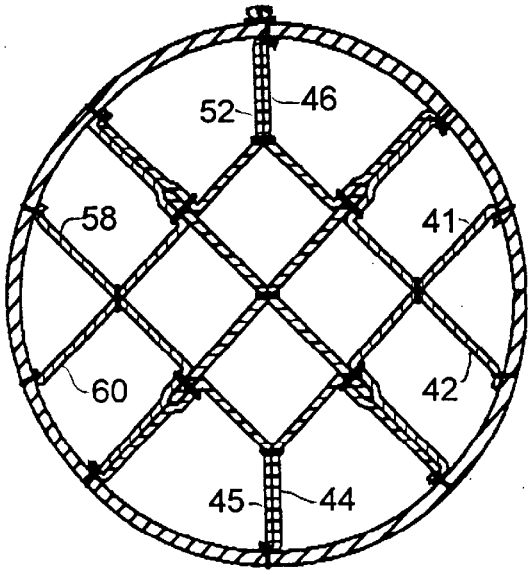
FIG. 5 is a plan view of a fourteen partition insert.
Figure 6:
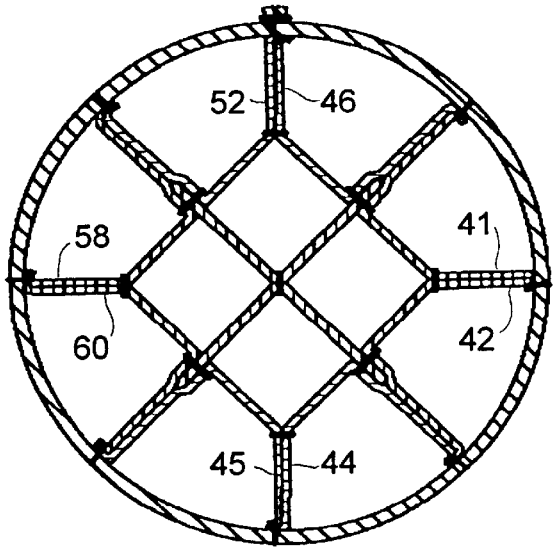
FIG. 6 is a plan view of a twelve partition insert.

By doubling any two of the four "M" strips outer edges (44, 45; 52, 46; 41, 42; 58, 60) the number of partitions will be reduced from sixteen to fourteen. FIG. 5 illustrates a fourteen partitions insert formed by doubling the outer legs 44, 45 and 46, 52. And FIG. 6 illustrates a twelve partition insert formed when all four "M" strip edges are doubled.

As previous noted, the maximum number of clubs permitted for tournament gold is fourteen. Therefore, fourteen is the preferred number of partitions in an golf bag insert. Generally, a putter and other irons are relatively thin and don't require must space in a bag, but the woods often do. Therefore, it is often desirable to have two or three larger spaces in the bag to accommodate the more bulky driver and other woods.

Figure 7:
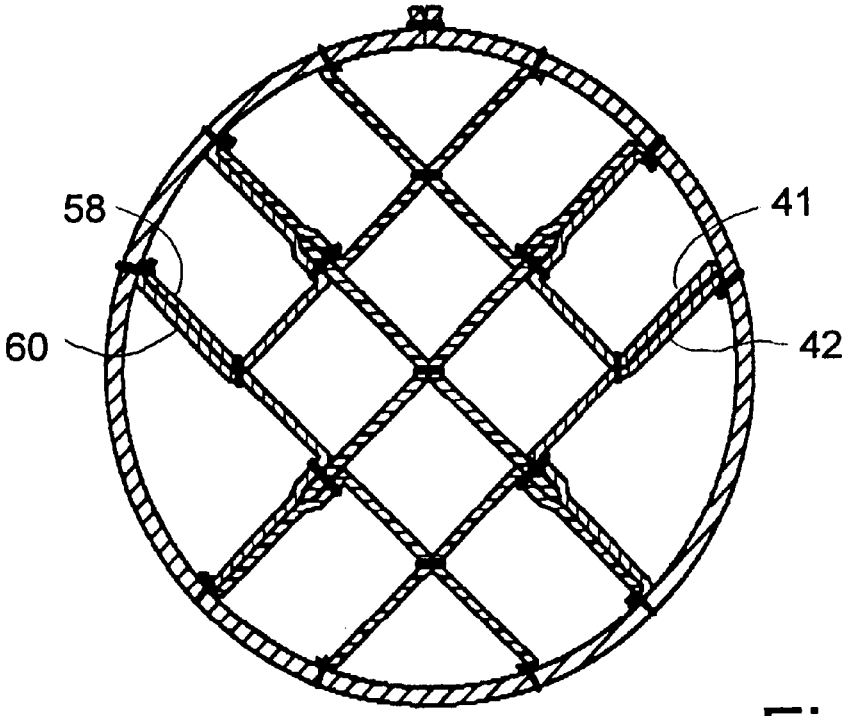
FIGS. 7 and 8 are alternate plan views of fourteen partition inserts.
Figure 8:
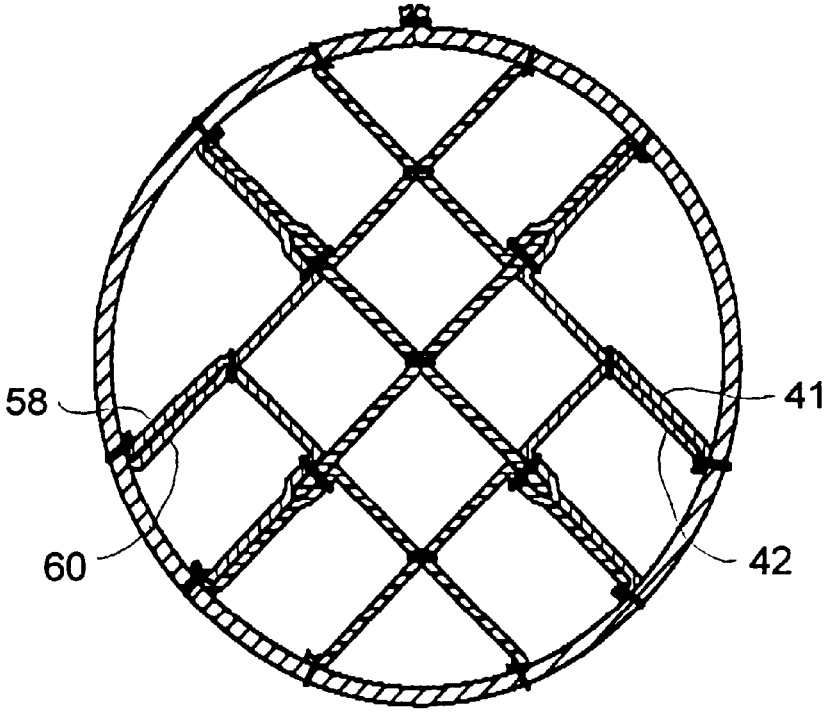

FIGS. 7 and 8 illustrate fourteen partition inserts each having a pair of oversized partitions made by doubling one outer leg over a fixed outer leg of an adjacent "M" strip. For example, in FIG. 7 the legs 41 and 58 remain fixed as in FIG. 3 and the outer legs 42 and 60 have been doubled over them to form two large partitions and twelve that remain unchanged from those of FIG. 3. FIG. 8 illustrates a similar but opposite configuration formed by doubling the outer legs 41 and 58 over fixed outer legs 42 and 60.

Figure 9:
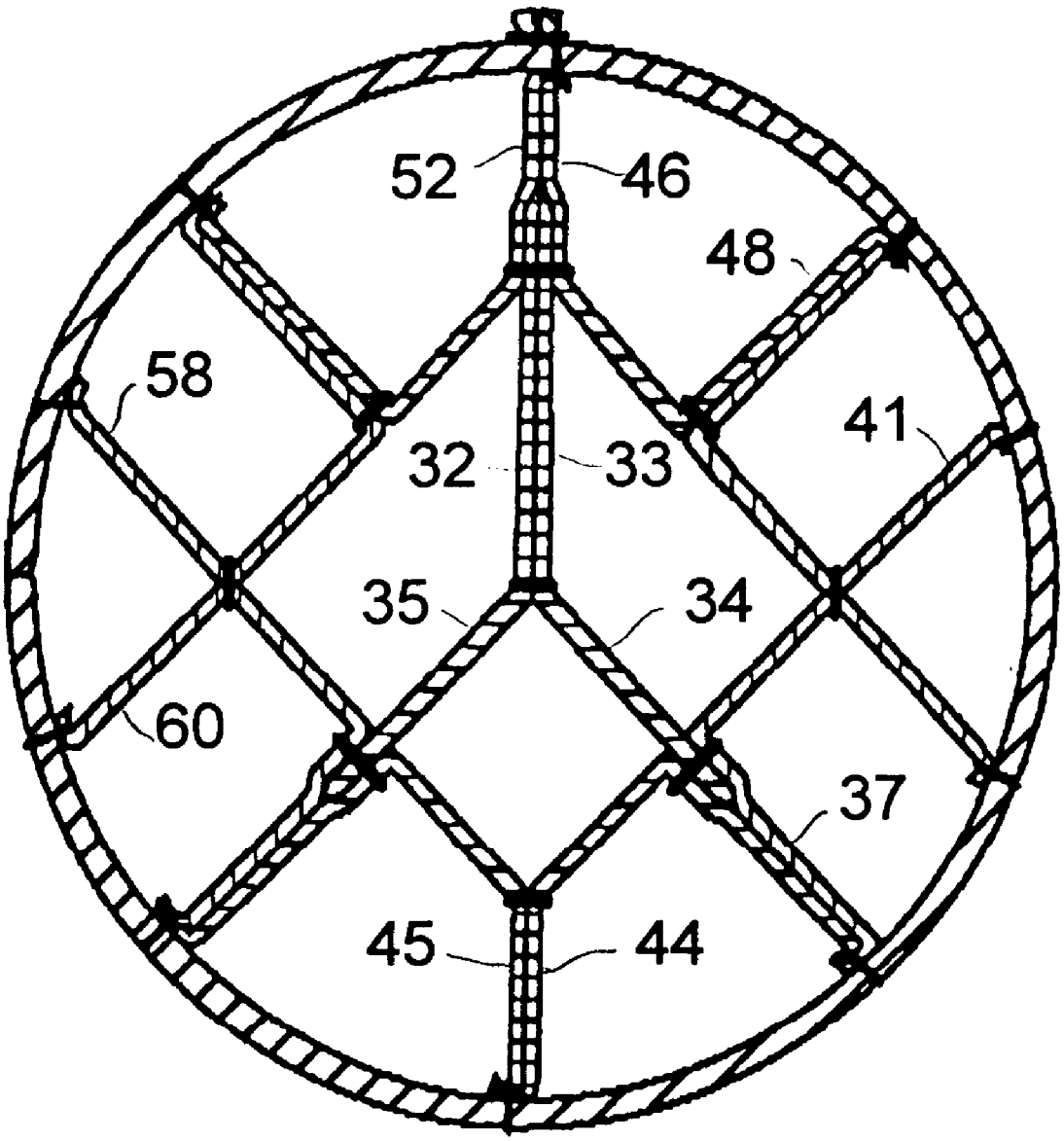
FIG. 9 is a plan view of a thirteen partition insert.

FIG. 9 illustrates the combining of legs of the "X" strip to obtain a thirteen partitions insert. It is to be noted that FIG. 9 is very similar to FIG. 5 but with 32, 33 of the central "X" strip combined with their edges bound together between outer legs 52, 46 of adjacent "M" strips. If desired, the legs 34, 35 of the "X" strip may also be combined and stitched between the outer legs 44, 45 of the adjacent "M" strips.

I claim:

1. The method of forming a golf bag insert with soft fabric partitions for golf clubs, said method comprising the steps of:

stitching together along their longitudinal centerlines two strips of fabric each having a width approximately twice the width of a single partition and a length corresponding to the length of said golf bag to form a strip having a cross section resembling an "X" with unattached edges;

folding in half along their longitudinal centerlines four sheets of fabric having a width approximately equal to the width of six single partitions and a length corresponding to the length of said golf bag, and longitudinally stitching said folded sheets at a point located approximately the width of a single partition from the point of said fold, thereby leaving a flap of unattached fabric approximately equal to the widths of two single partitions on each side of said stitching point;

longitudinally stitching the midpoint of said flap of unattached fabric to the midpoints of unattached fabric on adjacent sheets of fabric, each of said four sheets now folded and stitched into a form resembling a letter "M" with doubled center legs and single outer legs;

stitching the unattached edges of said "X" strip between selected pairs of center legs;

providing a fabric sheet having a length equal to the inside length of the golf bag and a width approximately equal to the inside circumference of said bag, and marking a surface of said sheet with longitudinal lines indicating a desired pattern of stitching of partitions;

stitching each point of fold and each outer edge of said folded sheet to said marked surface of said fabric sheet, and sewing the ends of said sheet together to form a tubular insert.

* * * * *